US007401430B2

(12) United States Patent
Lindquist et al.

(10) Patent No.: US 7,401,430 B2
(45) Date of Patent: Jul. 22, 2008

(54) SIGN MOUNTING SYSTEMS AND METHODS

(75) Inventors: Shannon P. Lindquist, Minneapolis, MN (US); Randy M. Staples, New Richmond, WI (US); Kent I. Kritz, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 216 days.

(21) Appl. No.: 10/838,141

(22) Filed: May 3, 2004

(65) Prior Publication Data

US 2005/0241201 A1 Nov. 3, 2005

(51) Int. Cl.
*A47G 29/10* (2006.01)

(52) U.S. Cl. ..... 40/657; 248/220.31; 40/661.03

(58) Field of Classification Search ..... None
See application file for complete search history.

(56) References Cited

U.S. PATENT DOCUMENTS

| | | | | | |
|---|---|---|---|---|---|
| 795,311 | A | | 7/1905 | Shepley | |
| 2,091,053 | A | | 8/1937 | Perkins | |
| 2,130,945 | A | | 9/1938 | Brownell | |
| 2,172,787 | A | | 9/1939 | Brownell | |
| 2,850,820 | A | | 9/1958 | Lersch | |
| 2,916,839 | A | * | 12/1959 | Wheaton | 40/622 |
| 2,921,393 | A | | 1/1960 | Wood | |
| 2,923,078 | A | | 2/1960 | Slavsky | |
| 2,941,321 | A | | 6/1960 | Wood | |
| 2,983,475 | A | | 5/1961 | Slavsky | |
| 3,041,760 | A | | 7/1962 | Slavsky | |
| 3,070,911 | A | | 1/1963 | Slavsky | |
| 3,071,880 | A | | 1/1963 | Taub | |
| 3,226,072 | A | | 12/1965 | Johnson | |
| 3,250,235 | A | * | 5/1966 | McDonnell | 108/152 |
| 4,384,418 | A | | 5/1983 | Alley | |
| 4,660,310 | A | * | 4/1987 | Farmer | 40/607.03 |
| D307,448 | S | | 4/1990 | Akard | |
| 5,617,661 | A | | 4/1997 | Mason | |
| 5,678,794 | A | | 10/1997 | Kump | |
| 5,832,644 | A | | 11/1998 | Mason | |
| D419,604 | S | | 1/2000 | Emmett | |
| 6,019,328 | A | * | 2/2000 | Allen | 248/220.31 |
| 6,354,546 | B1 | | 3/2002 | Mueller | |
| 6,363,643 | B1 | | 4/2002 | Padiak et al. | |
| 6,581,312 | B2 | | 6/2003 | Padiak et al. | |
| 2003/0019988 | A1 | | 1/2003 | Barber | |

* cited by examiner

*Primary Examiner*—Joanne Silbermann
(74) *Attorney, Agent, or Firm*—Ingrassia Fisher & Lorenz, P.C.

(57) ABSTRACT

An outrigger for mounting a dual-panel sign to a display system, the dual-panel sign having a first panel and a second panel positioned opposite the first panel. The outrigger includes a support end configured to be selectively coupled with the display system, an attachment end configured to be selectively coupled with the dual-panel sign between the first panel and the second panel, and an intermediate portion extending between the support end and the attachment end. The first panel and the second panel shield the attachment end from view. The support end, the attachment end, and the intermediate portion are each integrally formed of a rigid material. Sign assemblies and display systems provide additional advantages.

22 Claims, 11 Drawing Sheets

SIGN MOUNTING SYSTEMS AND METHODS

BACKGROUND OF THE INVENTION

Businesses typically use a wide variety of display systems to display products to consumers. Common display systems in retail environments include horizontally oriented display shelves, hooks secured to a vertical peg board or support wall system, racks, end caps, display cases, and other devices. In order to draw attention to the items displayed and/or assist the consumer in locating the particular item for which they are searching, flags or signs may be mounted to the display systems indicating the type of product, brand of product, advertising, or other information helpful to the consumer. Such flags or signs should extend from the display systems, be effective in communicating the product type, brand name, logo etc. to the consumer, and be aesthetically pleasing so as not to distract from the product display itself.

SUMMARY OF THE INVENTION

One embodiment of the present invention relates to an outrigger for mounting a dual-panel sign to a display system, the dual-panel sign having a first panel and a second panel positioned opposite the first panel. The outrigger includes a support end configured to be selectively coupled with the display system, an attachment end configured to be selectively coupled with the dual-panel sign between the first panel and the second panel, and an intermediate portion extending between the support end and the attachment end. The first panel and the second panel shield the attachment end from view. The support end, the attachment end, and the intermediate portion are each integrally formed of a rigid material. Other features and advantages are also disclosed.

BRIEF DESCRIPTION OF THE DRAWINGS

Embodiments of the invention will be described with respect to the figures, in which like reference numerals denote like elements, and in which.

DETAILED DESCRIPTION

Figure 1:
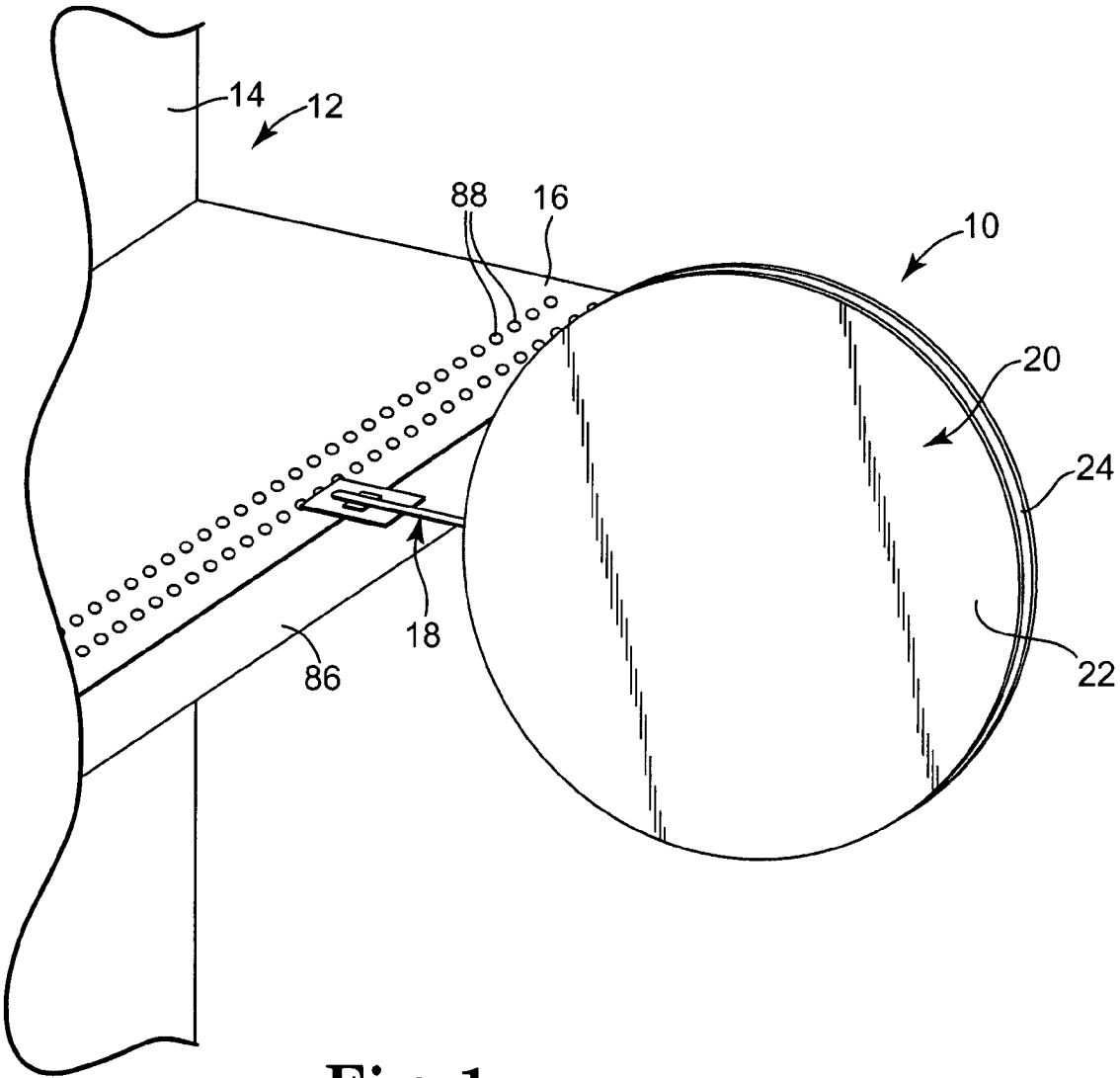
FIG. 1 is a perspective view illustrating one embodiment of a sign assembly coupled with a display system, according to the present invention.

FIG. 1 illustrates one embodiment of a sign assembly 10 selectively coupled with a display system 12. In one embodiment, display system 12 includes a first portion or vertical support wall 14 and a second portion or shelf 16 coupled with and extending substantially perpendicular to support wall 14. Sign assembly 10 includes an outrigger 18 and a dual-panel sign 20. The terms "dual" and "dual-panel" as used herein should be considered to include multiple panels, not just two panels. Outrigger 18 attaches to display system 12, specifically to a shelf 16, at one end and selectively couples to dual-panel sign 20 at the opposite end. With this in mind, outrigger 18 supports dual-panel sign 20 and spaces dual-panel sign 20 from shelf 16. In one embodiment, outrigger 18 is coupled to dual-panel sign 20 such that a portion of outrigger 18 is hidden between a first panel 22 and a second panel 24 of dual-panel sign 20. Otherwise stated, the first and second panels 22 and 24 shield a portion of the outrigger from view.

Figure 2A:
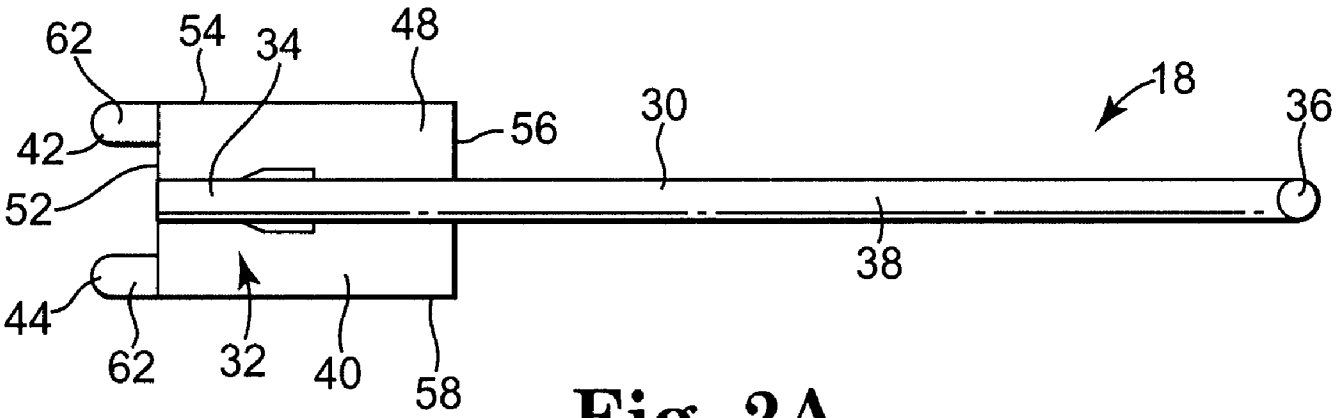
FIG. 2A is a top view illustrating one embodiment of an outrigger of the sign assembly illustrated in FIG. 1.
Figure 2B:
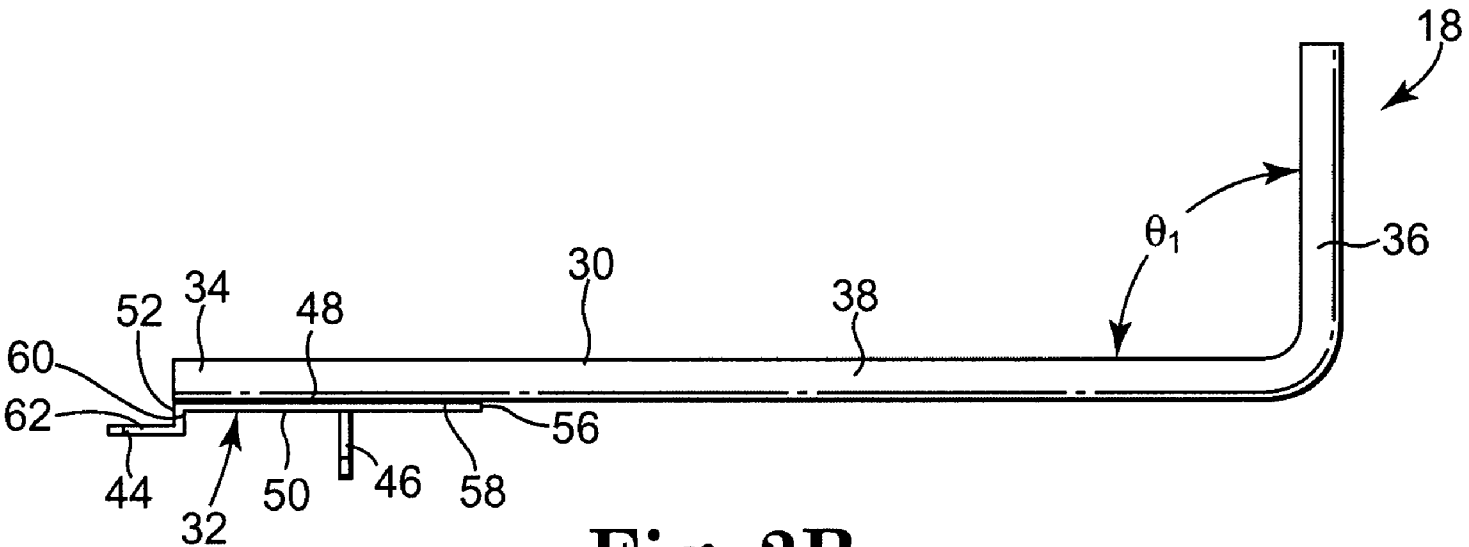
FIG. 2B is a side view of the outrigger of FIG. 2A.

FIGS. 2A and 2B illustrate a top view and a front view, respectively, of outrigger 18. In one embodiment, outrigger 18 includes a rod 30 and a mounting device 32. Rod 30 includes a support end 34, an attachment end 36 positioned opposite support end 34, and an intermediate portion 38 extending between support end 34 and attachment end 36. Support end 34 and intermediate portion 38 collectively extend in a substantially linear manner toward attachment end 36. Attachment end 36 extends from intermediate portion 38 in a substantially perpendicular manner. Angle $\theta_1$ defined between attachment end 36 and intermediate portion 38 is within the range of about 85° to about 95°, for example about 90°. Rod 30 is substantially rigid and generally non-deformable. Therefore, although rod 30 may have slight give, rod 30 maintains a consistent general shape during storage and during use of rod 30.

In one embodiment, mounting device 32 is a shelf adapter plate including a primary plate 40, a first hook 42, a second hook 44, and a third hook 46. Primary plate 40 defines a first surface 48 and a second surface 50 opposite first surface 48. Additionally, primary plate 40 defines a first edge 52, a second edge 54, a third edge 56, and a fourth edge 58, each extending between the first and second surfaces 48 and 50. More specifically, second edge 54 extends from first edge 52, third edge 56 extends from second edge 54 opposite first edge 52, fourth edge 58 extends from third edge 56 opposite second edge 54, and fourth edge 58 extends to first edge 52 opposite second edge 54.

First hook 42 and second hook 44 each extend from second surface 50 at first edge 52. Each of first hook 42 and second hook 44 define a first portion 60 and a second portion 62. First portion 60 extends from first edge 52 of second surface 50 in a direction opposite first surface 48. Second portion 62 extends from first portion 60 opposite primary plate 40 in a direction substantially parallel with primary plate 40 and away from first edge 52 in a direction opposite second edge 54. First hook 42 is spaced from second hook 44 along first edge 52. In one embodiment, first hook 42 is adjacent second edge 54 and second hook 44 is adjacent fourth edge 58 of primary plate 40.

Third hook 46 extends from second surface 50 of primary plate 40 in a direction opposite first surface 48. In one embodiment, third hook 46 is substantially centered between second and fourth edges 54 and 58 and is spaced from first edge 52 of primary plate 40. In one embodiment, third hook 46 extends from second surface 50 with a slight bend, curvature, or angle towards first edge 52. In one embodiment, mounting device 32 is formed of stamped metal. In one embodiment, the entirety of outrigger 18 is powder coated silver, cream, or other color to match or coordinate with display system 12.

Primary plate 40 is oriented with respect to rod 30 such that support end 34 of rod 30 is positioned near first edge 52 and intermediate portion 38 extends towards and past third edge 56. In one embodiment, rod 30 is positioned parallel with and centered between second edge 54 and fourth edge 58 of primary plate 40. In one embodiment, primary plate 40 is securely coupled with rod 30 via welding, adhesive, or other attachment means. In another embodiment, primary plate 40 may include a sleeve or rod reception channel (not illustrated) extending from first surface 48 parallel with second and fourth edges 54 and 58 for selectively receiving support end 34 of rod 30. In this embodiment, rod 30 can be selectively coupled and uncoupled with mounting device 32.

Figure 3B:
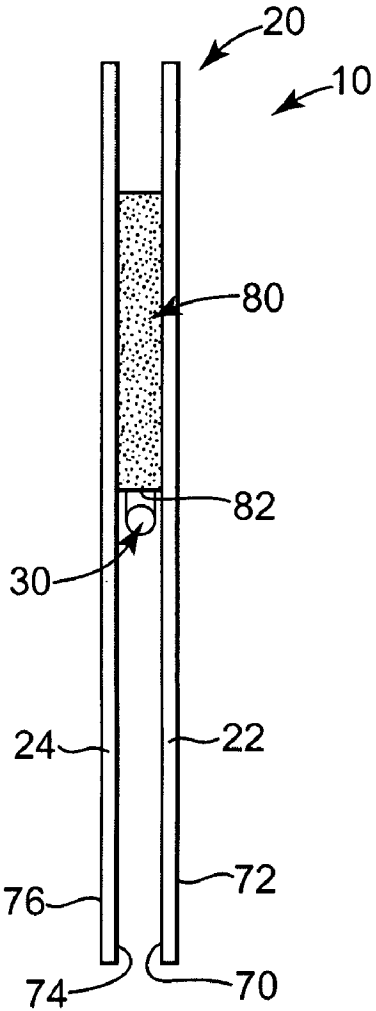
FIG. 3B is a back view of the sign assembly illustrated in FIG. 3A.
Figure 3A:
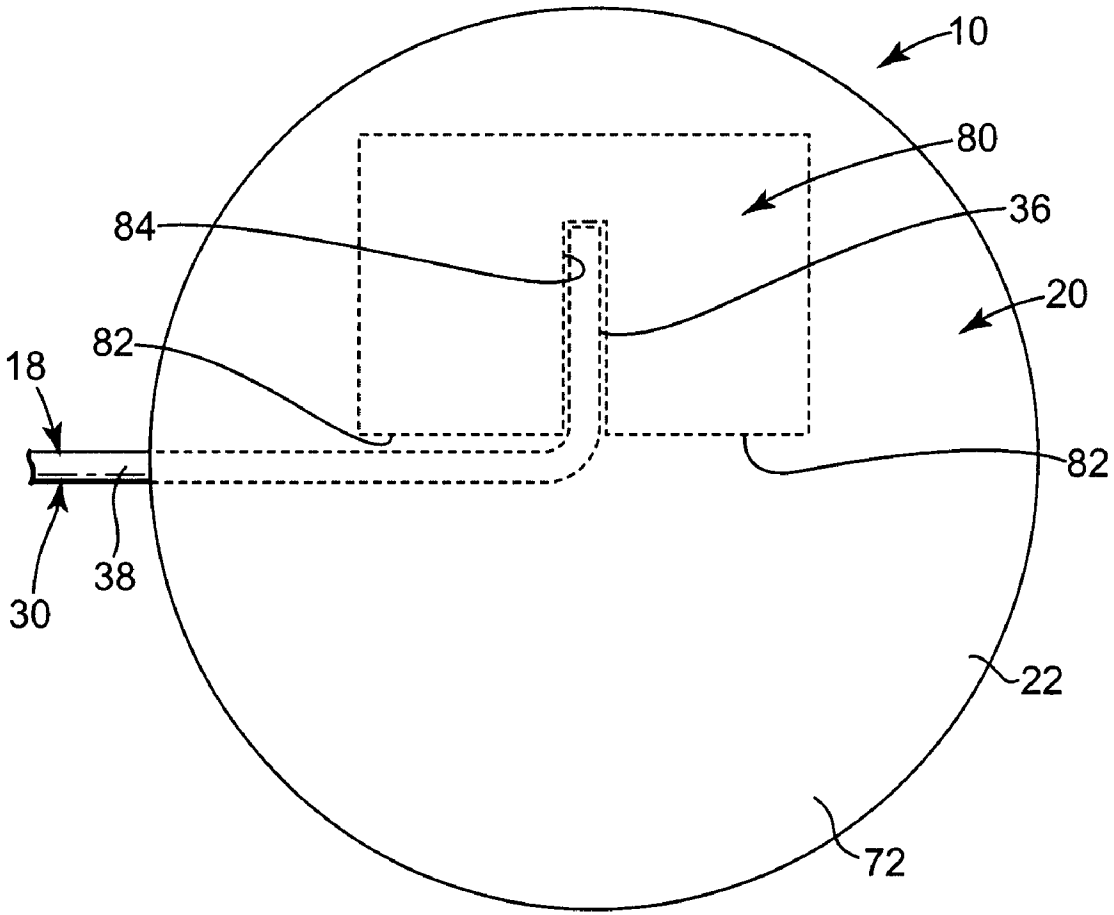
FIG. 3A is a side view illustrating a portion of one embodiment of the sign assembly illustrated in FIG. 1.

FIGS. 3A and 3B illustrate a side view and back view of one embodiment of dual-panel sign 20. First panel 22 defines an internal surface 70 and an external surface 72. Similarly, second panel 24 defines an interior surface 74 and an external surface 76. In one embodiment, first panel 22 and second panel 24 are similarly shaped as mirror images of one another to present a consistently shaped dual-panel sign 20 upon assembly. Product type, product brand, department identifier, sales information, advertising, or other information (including text and/or graphics) to be communicated with a consumer is printed upon or adhered to at least one of external surfaces 72 and 76. In one embodiment, each panel 22 and 24 is formed of foam core, paperboard, plastic, laminated paperboard, or any other sufficiently rigid sign material.

Dual-panel sign 20 additionally includes a spacer 80 positioned between the first and second panels 22 and 24. In one embodiment, spacer 80 is formed of foam or other lightweight material having a thickness sufficient to space first panel 22 from second panel 24 and to allow insertion of outrigger 18 between panels 22 and 24, as will be further described below. More specifically, spacer 80 is placed parallel with and sandwiched between panels 22 and 24 and adhered or otherwise attached to internal surfaces 70 and 74 of panels 22 and 24, respectively.

Spacer 80 defines a lower edge 82, which, in one embodiment, is a lowermost edge of spacer 80 and includes at least a portion that is substantially linear. Spacer 80 additionally forms a receptacle or cavity 84 extending from lower edge 82 into spacer 80. Cavity 84 extends from lower edge 82 with an orientation substantially similar to the orientation of attachment end 36 of outrigger rod 30 with respect to intermediate portion 38. In one embodiment, cavity 84 extends substantially perpendicular to lower edge 82.

Upon assembly, attachment end 36 of rod 30 is slid between the first and second panels 22 and 24 of dual-panel sign 20. In particular, attachment end 36 is inserted into cavity 84 of spacer 80. Due to the rigid nature of rod 30, rod 30 generally does not require deformation to be selectively coupled with dual-panel sign 20. In one embodiment, at least attachment end 36 and intermediate portion 38 each extend in a plane substantially parallel to each of the first and second panels 22 and 24 as illustrated, for example, with reference to FIG. 3B in view of FIG. 3A. As such, attachment end 36 is selectively maintained and held in place by spacer 80 and internal surfaces 70 and 74 of first and second panels 22 and 24. Notably, gravitational forces act upon dual-panel sign 20 to maintain dual-panel sign 20 positioned upon attachment end 36. Additionally, internal surfaces 70 and 74 of first and second panels 22 and 24 also interact with a portion of intermediate portion 38 as intermediate portion 38 extends between the panels 22 and 24 to decrease or generally prevent rotation of dual-panel sign 20 about attachment end 36.

Notably, attachment end 36 and at least part of intermediate portion 38 is effectively hidden between first and second panels 22 and 24 of dual-panel sign 20. Accordingly, the attachment end 36 is shielded from the view of the consumer, thereby presenting a clean and unobtrusive look to the consumer that does not distract from the message displayed on external surfaces 72 and/or 76 of dual-panel sign 20. In addition, in one embodiment, sign assembly 10 is configured to extend a distance from shelf 16 so as not to overly interfere with product visibility or access by a consumer.

Referring once again to FIG. 1, during assembly, mounting device 32 is attached to shelf 16. Shelf 16 defines a front edge 86 opposite support wall 14 and a plurality of apertures 88 extending parallel with and along front edge 86. First hook 42 and second hook 44 are each placed within one of the plurality of apertures 88. In addition, third hook 46 rests against front edge 86 of shelf 16. As such, the hooks 42, 44, and 46 function as at tripod attachment to shelf 16, selectively but securely maintaining outrigger 18 with respect to shelf 16. Due to the rigid nature of rod 30 and mounting device 32, rod 30 generally does not require deformation to be selectively coupled with display assembly 12. Sign assembly 10 is removed from display system 12 and dual-panel sign 20 is removed from outrigger 18 by reversing the assembly process described above.

Figure 4B:
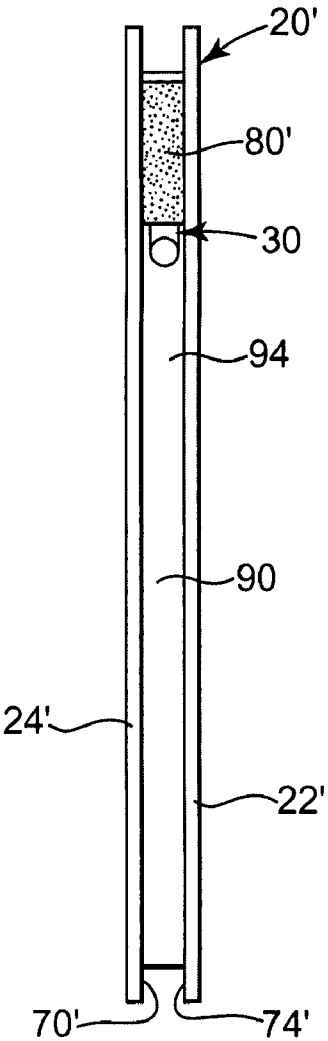
FIG. 4B is a back view of the sign assembly illustrated in FIG. 4A.
Figure 4A:
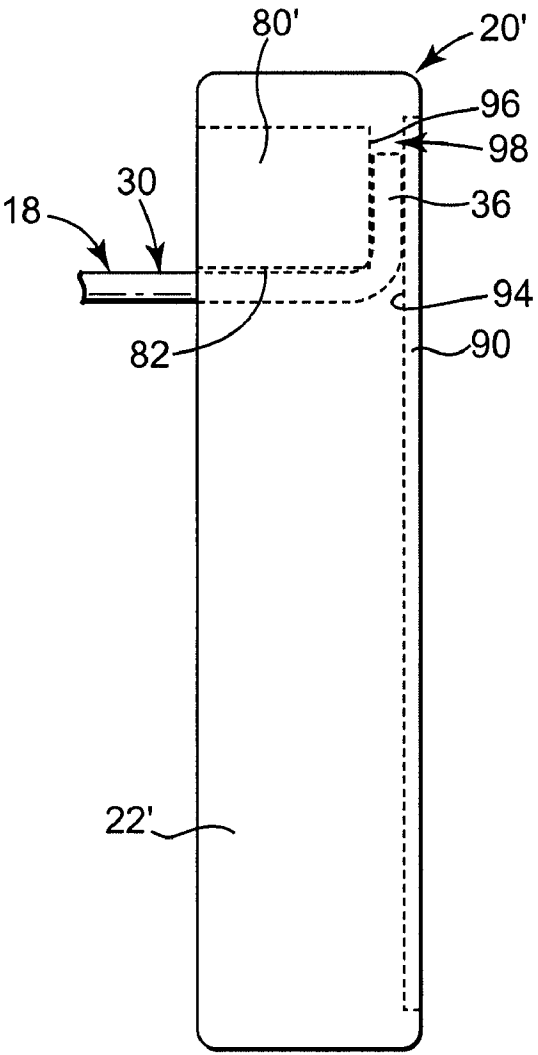
FIG. 4A is a side view illustrating a portion of one embodiment of a sign assembly including the outrigger illustrated in FIGS. 2A and 2B.

FIGS. 4A and 4B illustrate another embodiment of a dual-panel sign 20' for use with outrigger 18. As described above with respect to dual-panel sign 20, dual-panel sign 20' includes a first panel 22' and a second panel 24' similar to the first and second panels 22 and 24 except for the differences specifically described herein. In one embodiment, panels 22' and 24' are elongated or substantially rectangular in shape. In one embodiment, each of the corners defined by panels 22' and 24' are rounded, for aesthetic reasons and/or to generally prevent damage or injury.

Each panel 22' and 24' defines an internal surface 70' and 74', respectively. In one embodiment, dual-panel sign 20' additionally includes a third panel 90 positioned along a front edge 92 of dual-panel sign 20' between first and second panels 22' and 24'. Third panel 90 defines an internal surface 94. In one embodiment, first panel 22', second panel 24' and third panel 90 are formed of a single piece of material folded to create the three separate panels 22', 24', and 90.

Dual-panel sign 20' additionally includes a spacer 80', formed of a material similar to that of spacer 80 described above. In one embodiment, spacer 80' is generally in the shape of a polygon and includes a lower edge 82, which is substantially linear, and a front edge 96 extending from lower edge 82. In one embodiment, front edge 94 is positioned substantially perpendicular with respect to lower edge 82.

Spacer 80' is sandwiched between and positioned parallel with first and second panels 22' and 24'. More specifically, spacer 80' is adhered or otherwise coupled to internal surfaces 70' and 74' of the first and second panels 22' and 24', respectively. In one embodiment, spacer 80' is positioned within dual-panel sign 20' such that front edge 96 is spaced from internal surface 94 of third panel 90 a distance greater than the thickness or diameter of attachment end 36 of outrigger 18. Accordingly, internal surfaces 70', 74', and 94 of panels 22', 24', and 90 and front edge 96 of spacer 80' collectively define a cavity or receptacle 98.

Upon assembly, outrigger 18, and more specifically, attachment end 36 of outrigger 18, is positioned between first and second panels 22' and 24' and placed within receptacle 98. With this in mind, attachment end 36 is selectively maintained between panels 22', 24', and 90 and spacer 80'. In a similar manner as described above, a portion of intermediate portion 38 of outrigger 18 extends along lower edge 82 of spacer 80 and is sandwiched between first and second panels 22' and 24' to generally prevent rotation of dual-panel sign 20' about support end 34 of outrigger 18. Dual-panel sign 20' is uncoupled with outrigger 18 by reversing the assembly process described above.

Notably, although dual-panel sign 20 is illustrated as a circle and dual-panel sign 20' is illustrated as a rectangle, dual-panel signs 20 and 20' are any desired sign shape, such as an oval, diamond, square, rectangle, amoebic, dialog bubble, thought bubble, scalloped, curvilinear, triangle, etc. shape. In one embodiment, sign shapes are categorized as compact or elongated. Compact signs refer to signs 20 or 20' that are shaped as circles, ovals, squares, or other non-elongated shapes. In one embodiment, all compact signs are sized and shaped to fit within a 9 inch by 9 inch dimensioned square (not illustrated). Elongated signs refer to signs 20 or 20' that are rectangles, ovals, or other shapes have a length substantially larger than their width. In one embodiment, elongated signs are sized and shaped to fit with in a rectangle (not illustrated) with a width of approximately 5 inches and a length of approximately 24 inches.

Figure 5:
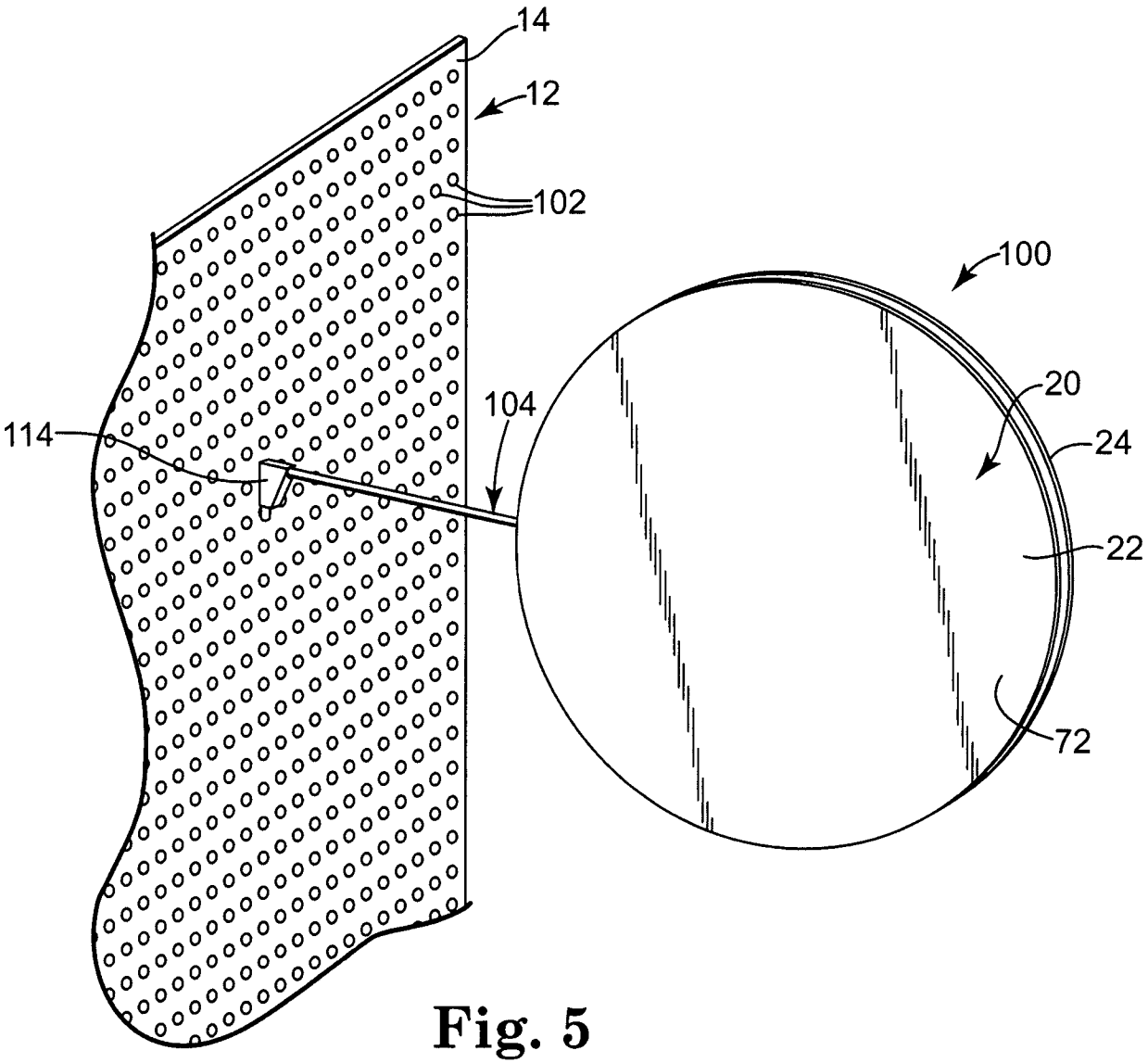
FIG. 5 is a perspective view illustrating one embodiment of a sign assembly coupled with a display system, according to the present invention.

FIG. 5 illustrates one embodiment of a sign assembly 100 for attachment to display system 12. In this embodiment, display system 12 includes support wall 14, at least a portion of which is a peg board defining an array of apertures 102. An outrigger 104 extends directly from support wall 14, rather than from shelf 16 (illustrated in FIG. 1), to support and selectively maintain dual-panel sign 20 or dual-panel sign 20' (illustrated in FIG. 4) opposite support wall 14.

Figure 6:
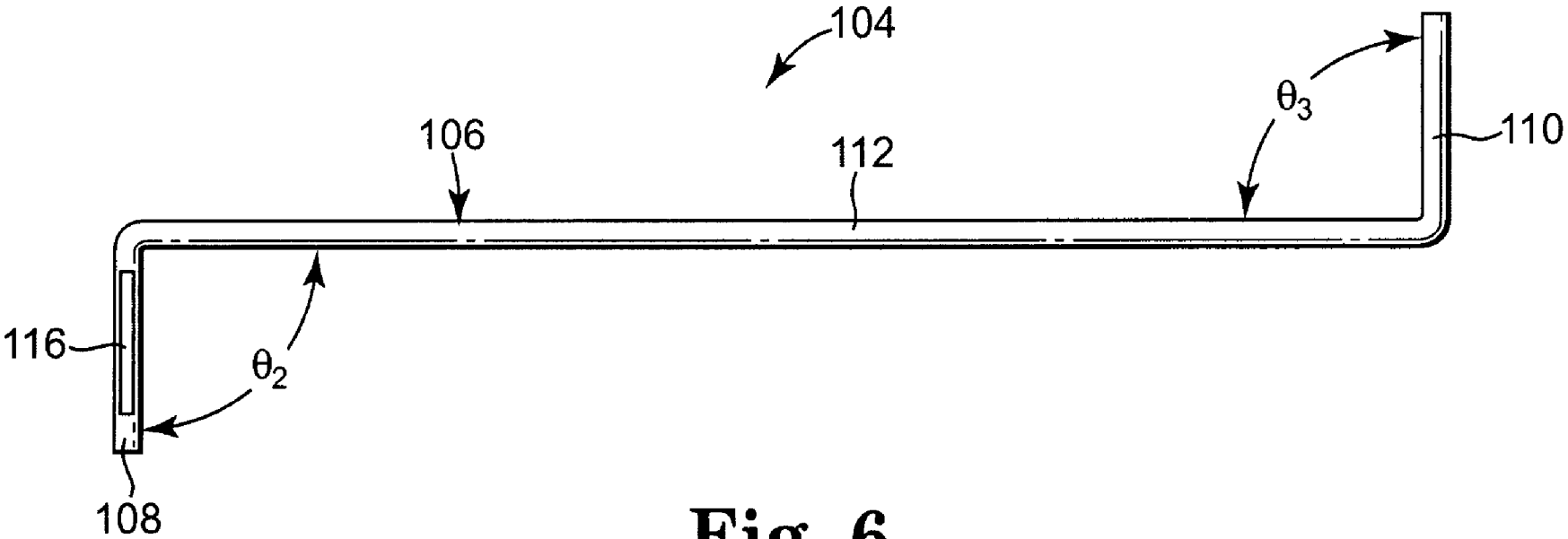
FIG. 6 is a side view illustrating one embodiment of an outrigger of the sign assembly illustrated in FIG. 5.

With additional reference to FIG. 6, outrigger 104 includes a rod or rigid wire 106 similar to rod 30 described above except for those differences specifically described herein. As such, rod 106 is substantially rigid and generally non-deformable. Therefore, although rod 106 may have slight give, rod 106 maintains a consistent general shape during storage and during use of rod 106. Rod 106 includes a support end 108, an attachment end 110, and an intermediate portion 112. Support end 108 is positioned opposite attachment end 110, and each end 108 and 110 extends from intermediate portion 112. Intermediate portion 112 extends in a substantially linear manner between ends 108 and 110 as described above with respect to intermediate portion 38.

Support end 108 extends from intermediate portion 38 in a substantially perpendicular manner. Support end 108 and intermediate portion 112 define an angle $\theta_2$ within the range of about 85° to about 95°, for example about 90°. Attachment end 110 extends from intermediate portion 112 in a similar manner as described above with respect to attachment end 36 and intermediate portion 38 in a direction opposite the extension of support end 108. More specifically, in one embodiment, attachment end 110 and intermediate portion 112 are substantially perpendicular to one another. Attachment end 110 and intermediate portion 112 define an angle $\theta_3$ between them within the range of about 85° to about 95°, for example about 90°. In one embodiment, attachment end 110 extends vertically upward from intermediate portion 112 and support end 108 extends vertically downward from intermediate portion 112.

Support end 110 of outrigger 104 interacts with dual-panel sign 20 or 20' in a similar manner as described above with respect to outrigger 18. Due to the rigid nature of rod 106 of outrigger 104, rod 106 generally does not require deformation to be selectively coupled with dual-panel sign 20 or 20'.

Outrigger 104 is selectively secured to support wall 14 by a mounting device or fastback 114. In one embodiment, outrigger 104 additionally includes orientation indicia 116, such as, a printed statement or other physical characteristic indicating the proper orientation of outrigger 104. In one embodiment, orientation indicia 116 is a statement similar to "This end in mounting device" stamped or otherwise printed on support end 108. In one embodiment, mounting device 114 is a conventional mounting device configured to interface with the array of apertures 102 of support wall 14 to be securely mounted upon support wall 14. Note that due to the rigid nature of rod 106 and mounting device 114, rod 106 of outrigger 104 generally does not require deformation to be selectively coupled with support wall 14 or mounting device 114.

In addition, mounting device or fastback 114 includes a cavity and ledge (not illustrated) for supporting support end 108 and a part of intermediate portion 112, thereby supporting outrigger 104 in both vertical and horizontal directions. Angle $\theta_2$ is specifically defined to match the orientation and dimensions of mounting device 114. In one embodiment, mounting device 114 is permanently formed from or coupled with support end 108. In one embodiment, mounting device 114 is separately formed and selectively receives support end 108. Dual-panel sign 20 or 20' is removed from outrigger 104 and outrigger 104 is removed from display system 12 by reversing the assembly process described above.

Note that since dual-panel signs 20 and 20' are each configured to be used with either outrigger 18 or outrigger 104, dual-panel signs 20 and 20' can be selectively and interchangeably used with outrigger 18 and outrigger 104. Accordingly, in one embodiment a sign assembly system (not shown) includes outrigger 18, outrigger 104, and at lease one of dual-panel signs 20 and 20'.

Figure 7:
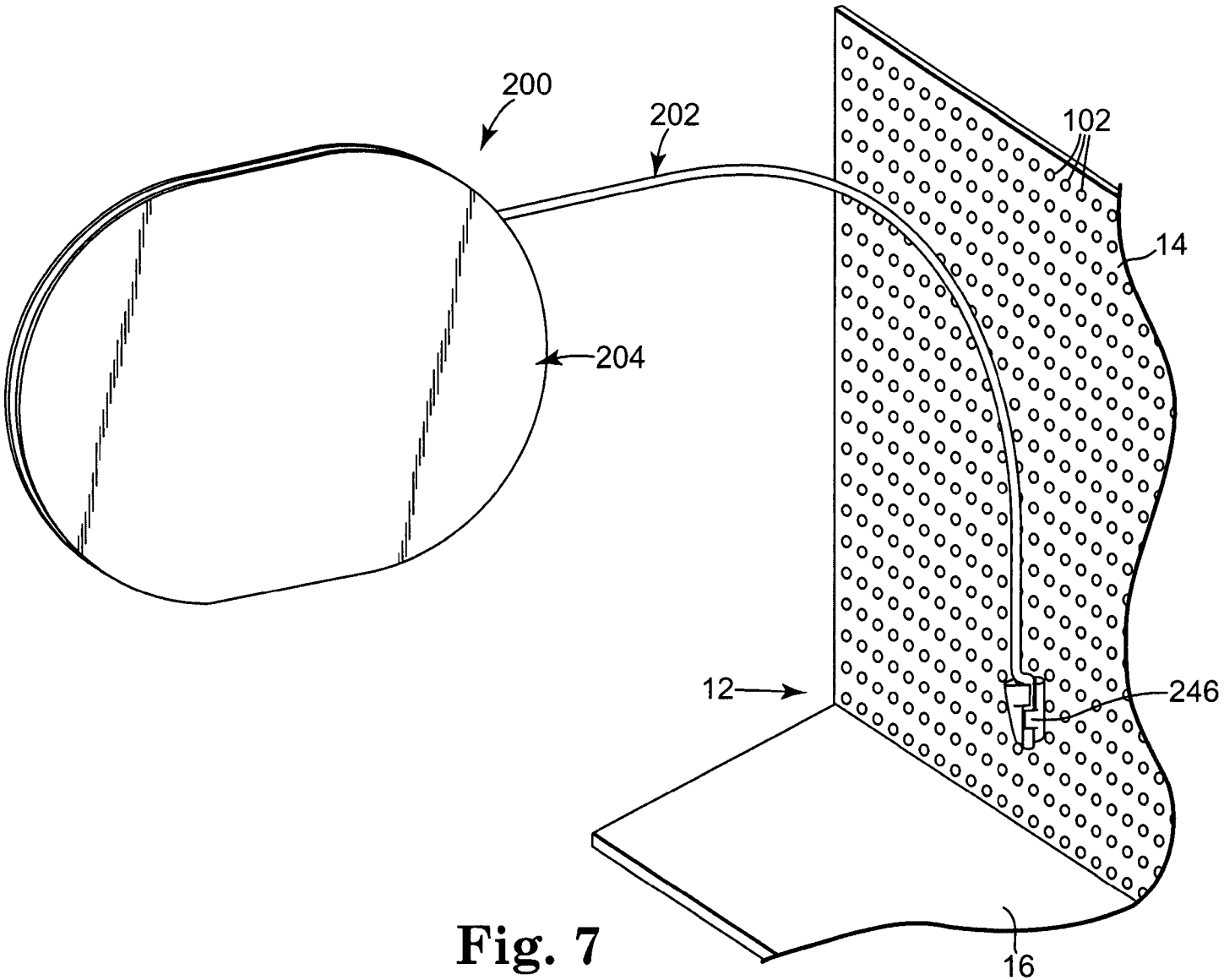
FIG. 7 is a perspective view illustrating one embodiment of a sign assembly coupled with a display system, according to the present invention.

FIG. 7 illustrates another embodiment of a sign assembly 200 attached to display system 12. Sign assembly 200 includes an outrigger 202 and a dual-panel sign 204. Outrigger 202 selectively couples with support wall 14 of display system 12. Outrigger 202 also selectively couples with sign assembly 204 opposite support wall 14 to support dual-panel sign 204 and to maintain dual-panel sign 204 spaced from support wall 14.

Figure 8:
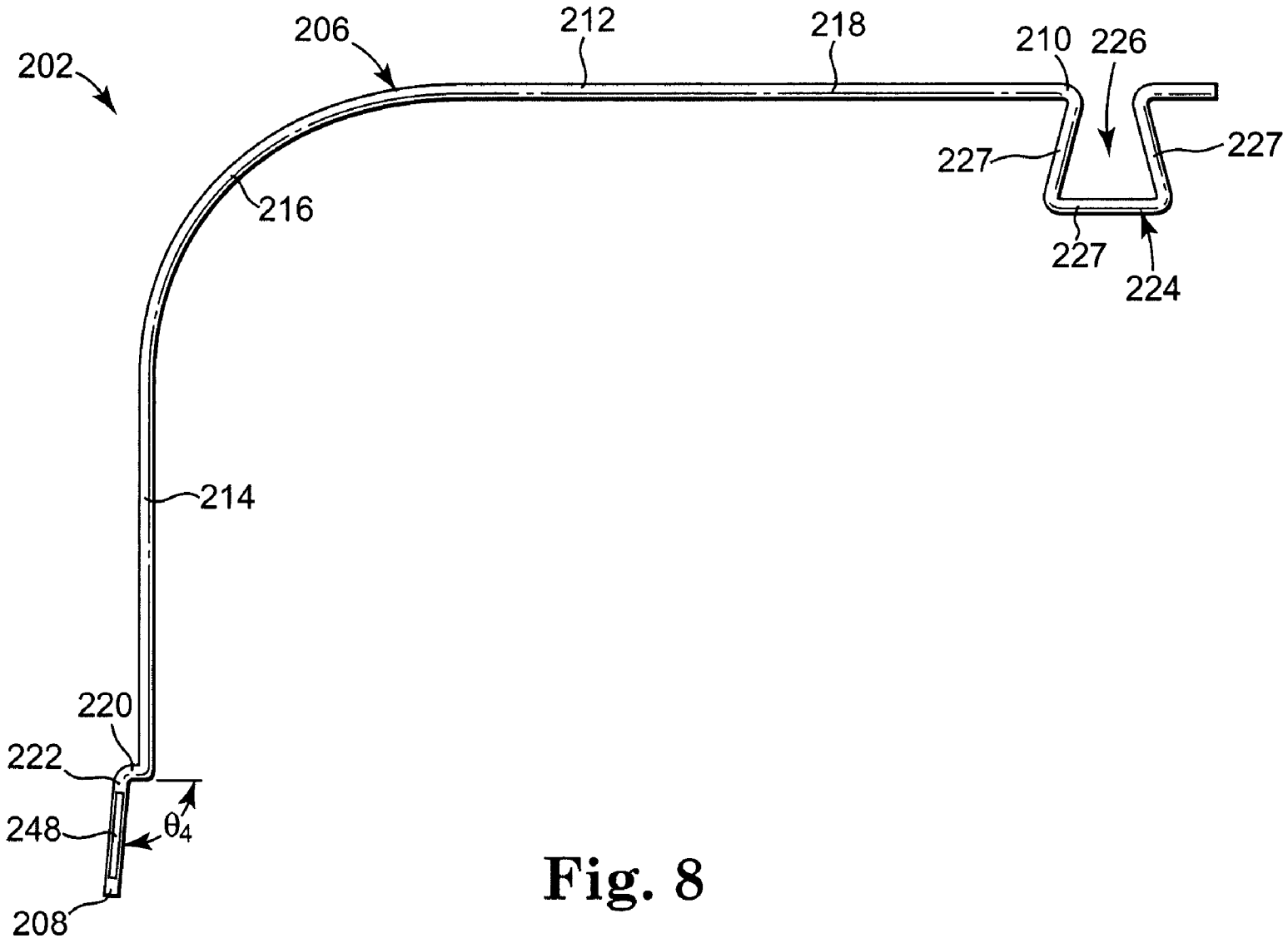
FIG. 8 is a side view illustrating one embodiment of an outrigger of the sign assembly illustrated in FIG. 7.

FIG. 8 illustrates one embodiment of outrigger 202. Outrigger 202 includes a rod 206, similar to rod 30 described above, defining a support end 208, an attachment end 210, and an intermediate portion 212 extending between support end 208 and attachment end 210. Rod 206 is substantially rigid and generally non-deformable. Therefore, although rod 206 may have slight give, rod 206 maintains a consistent general shape during storage and during use of rod 206.

In one embodiment, support end 208, attachment end 210, and intermediate portion 212 are integrally formed of a rigid metallic material. In one embodiment, intermediate portion 212 includes a vertical section 214, a curvilinear section 216, and a horizontal section 218. Vertical section 214 and horizontal section 218 are each coupled to curvilinear section 216 opposite one another. In other embodiments, intermediate portion 212 does not include vertical and/or horizontal sections but is at least partially curvilinear. In one embodiment, intermediate portion 112 does not include curvilinear section 216 and vertical and horizontal sections 214 and 218 are extended and coupled with each other at the intersection between the sections 214 and 218.

In one embodiment, support end 208 extends from vertical section 214 of intermediate portion 212. Support end 208 includes an offset section 220 and extension section 222. Offset section 220 extends from intermediate portion 212 in a substantially horizontal manner. Extension section 222 extends from offset section 220 opposite intermediate portion 212 in a substantially perpendicular manner. Extension section 222 is substantially perpendicular to offset section 220. Angle $\theta_4$ formed between extension section 222 and offset section 220 is within a range of about 85° to about 95°, for example about 90°.

Attachment end 210 extends from horizontal section 218 of intermediate portion 212. In one embodiment, attachment end 210 defines a spacer receptacle 224. Spacer receptacle 224 is formed by bending or otherwise forming attachment end 210 to define a void 226 between legs 227 of spacer receptacle 224. In one embodiment, the void 226 defined by spacer receptacle 224 is generally in the shape of a polygon. More specifically, in one embodiment, void 226 defined by spacer receptacle 224 is generally in the shape of a trapezoid. Spacer receptacle 224 is configured to receive a spacer 228 (illustrated in FIG. 9A) of dual-panel sign 204 (illustrated in FIG. 7) as will be further described below.

Figure 9B:
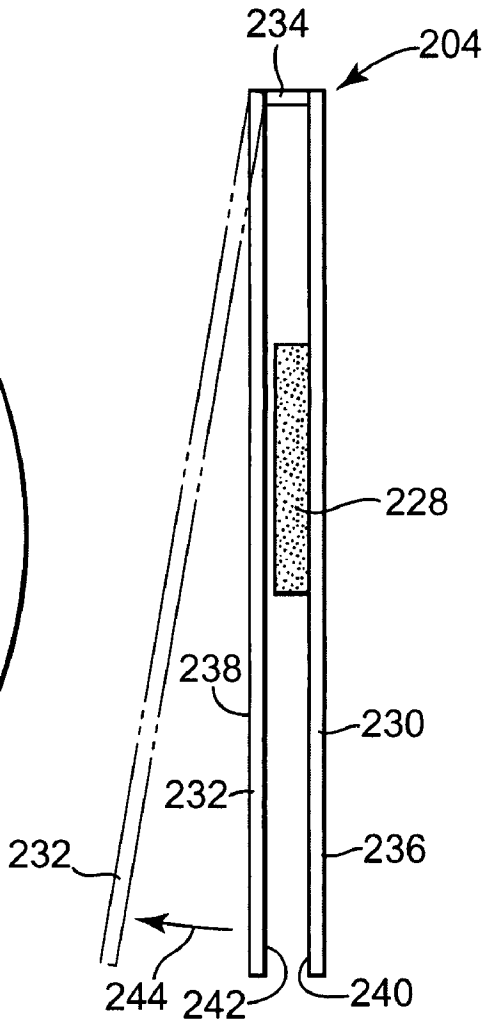
FIG. 9B is a back view illustrating one embodiment of a dual-panel sign of the sign assembly illustrated in FIG. 7.
Figure 9A:
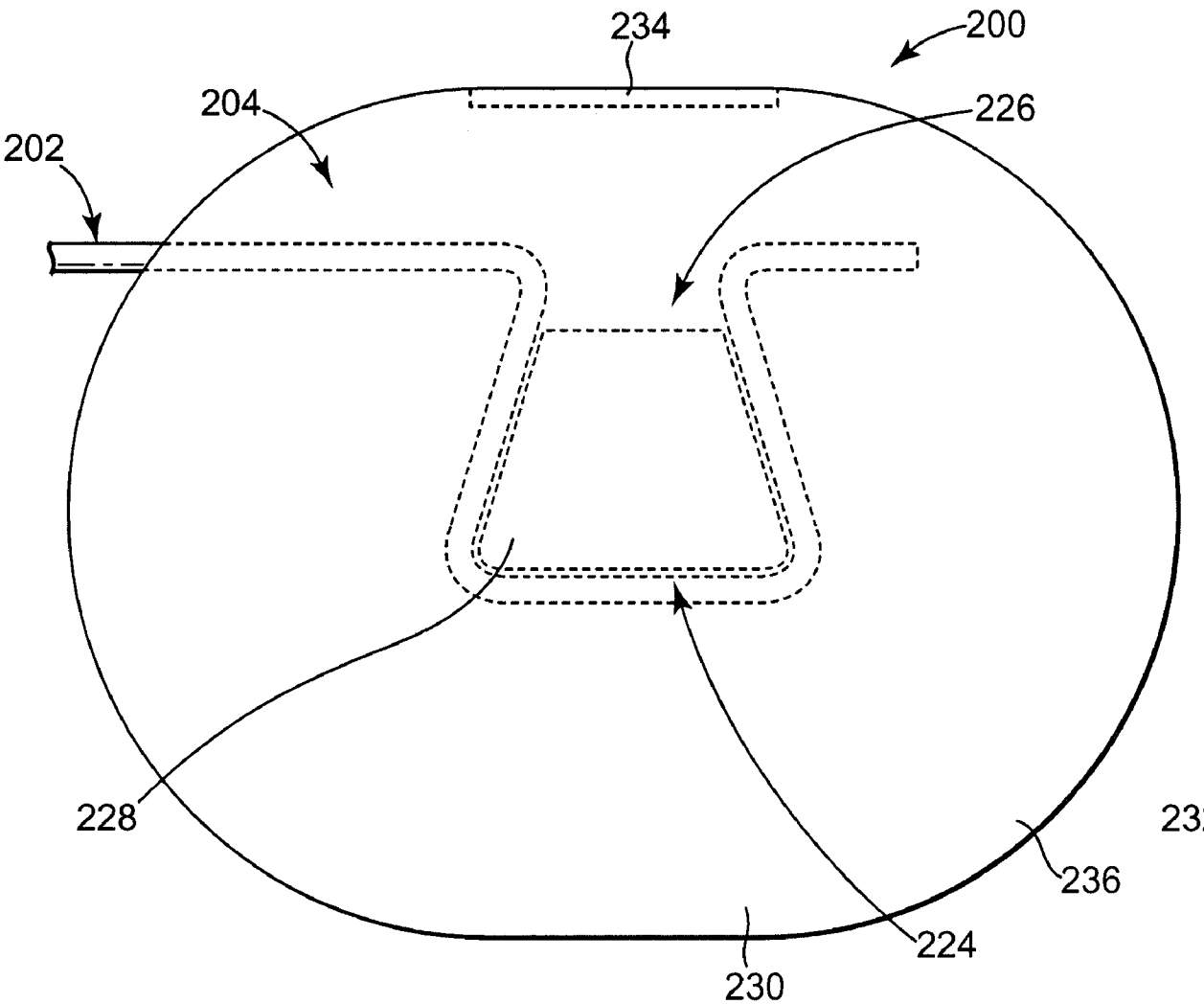
FIG. 9A is a side view illustrating a portion of one embodiment of the sign assembly of FIG. 7.

FIG. 9A illustrates a side view of sign assembly 200, and FIG. 9B illustrates a front view of dual-panel sign 204. Dual-panel sign 204 additionally includes a first panel 230, a second panel 232, and a third panel 234. First panel 230 and second panel 232 are positioned opposite one another and are sized and shaped in a substantially similar manner. Third panel 234 extends between first and second panels 230 and 232. In one embodiment, first panel 230, second panel 232, and third panel 234 are integrally formed of a material such as foam core, paperboard, laminated paperboard, plastic, etc., and folded such that first panel 230 and second panel 232 are positioned directly opposite one another with third panel 234 extending between the first and second panels 230 and 232. In one embodiment, dual-panel sign 204 is formed such that first panel 230 and second panel 232 are biased towards one another. External surfaces 236 and 238 defined by first and second panels 230 and 232, respectively, include a product name, product type, advertising, or other message to the consumer relating to the products displayed near sign assembly 200.

In one embodiment, spacer 228 is generally formed as a polygon, such as, a trapezoid, a triangle, a rectangle, a square, etc., or other shape such as a circle, an oval, etc., sized to be received by spacer receptacle 224 of outrigger 202. More specifically, in one embodiment, spacer 228 is formed as a trapezoid, and spacer receptacle 224 is similarly formed as a trapezoid slightly larger than spacer 228. Spacer 228 is formed of foam or any other lightweight material having a sufficient thickness and stability to maintain first panel 230 spaced from second panel 232. With this in mind, spacer 228 extends parallel to and is essentially sandwiched between panels 230 and 232. In one embodiment, spacer 228 is substantially centered with respect to each of panels 230 and 232. Spacer 228 is adhered to or otherwise coupled with an internal surface 240 defined by first panel 230. Notably, an internal surface 242 defined by second panel 232 is not adhered to or otherwise coupled with spacer 228.

During assembly of sign assembly 200, second panel 232 is rotated about its connection with third panel 234 away from first panel 230 as indicated by arrow 244. More specifically, a force is applied to second panel 232 to overcome the bias of second panel 232 towards first panel 230 and to rotate second panel 232 away from first panel 230 as indicated in the phantom lines of FIG. 9B. While second panel 232 is rotated away from first panel 230, outrigger 202 is positioned between the first and second panels 230 and 232 placing spacer 228 within void 226 formed by receptacle 224. Due to the rigid nature of rod 206, rod 206 of outrigger 202, which defines receptacle 224, generally does not require deformation to be selectively coupled with dual-panel sign 204.

Once outrigger 202 is in place and spacer receptacle 224 is selectively maintaining spacer 228, the external force is removed from second panel 232, and second panel 232 rotates back to its original position due to the bias of second panel 232. Notably, the interaction of spacer 228 and spacer receptacle 224, namely legs 227, not only horizontally and vertically supports spacer 228 and, therefore, dual-panel sign 204, but also generally prevents rotation of dual-panel sign 204 about attachment end 210 of outrigger 202. In order to remove dual-panel sign 204 from outrigger 202, the assembly process described above is simply reversed.

Sign assembly 200 is coupled with display system 12. In particular, a mounting device 246 is coupled with support end 208 of outrigger 202. Due to the rigid nature of rod 206 and mounting device 246, support end 208 defined by rod 206 generally does not require deformation to be selectively coupled with display assembly 12. Mounting device 246 is configured to interact with at least two apertures 102 of support wall 14 and to receive and support outrigger 202. In one embodiment, mounting device 246 is either permanently secured to support end 208 or is configured to selectively receive support end 208. In one embodiment, mounting device 246 is a fastback. In one embodiment, outrigger 202 includes orientation indicia 248 indicating which end of outrigger 202 is support end 208 similar to indicia 116 (illustrated in FIG. 6) described above.

In one embodiment, mounting device 246 receives extension section 222 of support end 208 to support outrigger 202 in both the horizontal and vertical directions. In one embodiment, mounting device 246 also interacts with offset section 220 to additionally support outrigger 202 in the vertical direction. Sign assembly 200 is disassembled from display system 12 by reversing the assembly steps described above.

Figure 10:
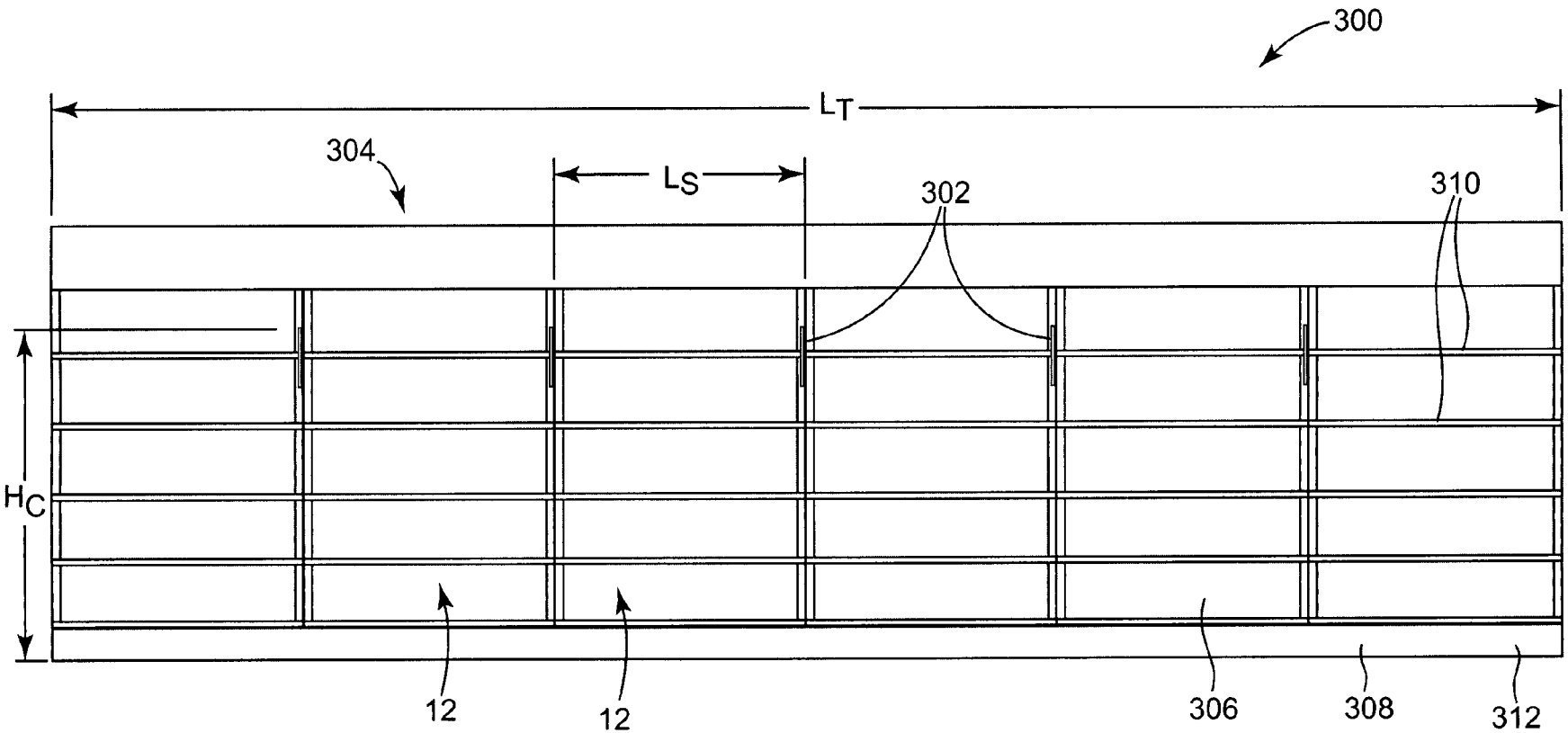
FIG. 10 is a front view illustrating one embodiment of a placement system of a plurality of sign assemblies along an integrated display system, according to the present invention.

FIG. 10 illustrates a placement system 300 for arranging a plurality of sign assemblies 302 on an integrated display assembly 304. Each of the plurality of sign assemblies 302 are similarly formed. In one embodiment, the plurality of sign assemblies 302 includes a plurality of sign assemblies 10 (illustrated in FIG. 1), a plurality of sign assemblies 100 (illustrated in FIG. 5), and/or a plurality of sign assemblies 200 (illustrated in FIG. 7).

Integrated display assemblies 304 is a plurality of display systems 12 positioned end-to-end placed upon and supported by a generally horizontal base deck 308 supported by the floor (not illustrated) or other support of the store or business. As such, at least one support wall 306 extends vertically from the top of base deck 308. A plurality of shelves 310, which are similar to shelf 16, extend substantially vertically from the at least one support wall 306 in the same direction as base deck 308. In one embodiment, integrated display assemblies have a total length $L_T$. In one embodiment, the total length $L_T$ is equal to approximately 24 feet.

The plurality of sign assemblies 302 are spaced from one another along the total length $L_T$ a distance or spaced length $L_S$, wherein spaced length $L_S$ is substantially identical between each adjacent sign assembly 304. In one embodiment, spaced length $L_S$ is at least 3.5 feet, more particularly 4 feet. In one embodiment, in which each of the plurality of sign assemblies 302 is a compact sign (such as, a round, square, oval, etc.), the top of each sign is placed a height $H_C$ from the bottom of base deck 308 (i.e. from the floor). In one embodiment, the height $H_C$ from the floor to the top of each of the plurality of sign assemblies 302 is equal and, thereby, each of the plurality of sign assemblies 302 is vertically aligned. In one embodiment, the height $H_C$ is equal to approximately 53 inches or similar height that places the plurality of sign assemblies 302 within the line of vision of a consumer.

Figure 11:
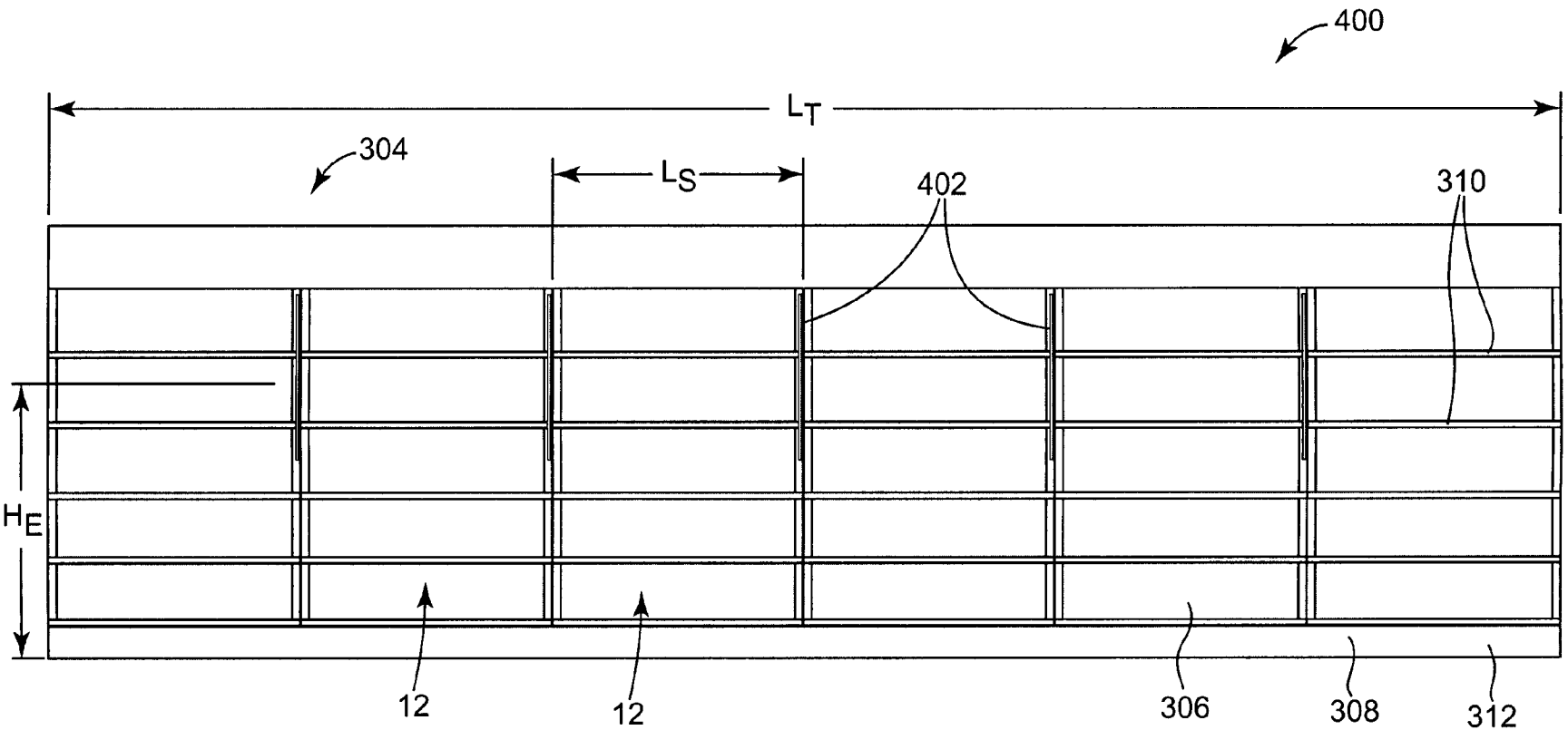
FIG. 11 is a front view illustrating one embodiment of a placement system of a plurality of sign assemblies along an integrated display system, according to the present invention.

FIG. 11 illustrates one embodiment of a placement system 400 including a plurality of sign assemblies 402 coupled to integrated display assemblies 304. Placement system 400 is similar to placement system 300 except for those differences enumerated below. The plurality of sign assemblies 402 are elongated signs or signs with a vertical orientation, such as rectangular, vertical oval, scalloped, etc., shaped signs having similar attributes as described with respect to sign assembly 10 (illustrated in FIG. 1), sign assembly 100 (illustrated in FIG. 5), or sign assembly 200 (illustrated in FIG. 7). The plurality of sign assemblies 402 are vertically aligned. More particularly, each of the sign assemblies 402 is positioned such that the middle of each sign assembly 402 is positioned from the bottom of base deck 308 or the floor (not illustrated) a height $H_E$. In one embodiment, the sign height $H_E$ is equal to approximately 53 inches or other similar distance placing each of the sign assemblies 402 within the line of sight of a consumer.

With the above in mind, a plurality of sign assemblies 302 or 402 can be placed along integrated display assemblies 304 for maximum impact upon the desired consumer. In one embodiment, placement of sign assemblies 302 and/or 402 contributes to product visibility without decreasing shopability, traffic flow (i.e., the sign assemblies 302 and/or 402 do not overly crowd the aisle in front of sign assemblies 302 and/or 402), or access to the product. Moreover, outriggers 18, 104, or 202 are not visually distracting to the consumer nor positioned to interfere with placement of the associated product on display system 12. In one embodiment, each of the plurality of sign assemblies 302 or 402 extends from integrated display system 304 horizontally beyond an outer edge 312 of base deck 308. In particular, in one embodiment, each of the plurality of sign assemblies 302 or 402 extends beyond the outer edge 312 of base deck 308 a distance of not more than 4.5 inches.

In one embodiment, coloring or design of sign assemblies 302 and 402 can further be part of an entire store product and sign placement plan. For example, all sign assemblies 302 or 402 within a particular department of a retail store may have a particular color, shape, or other characteristic that uniformly identifies the department while still having individualized text or graphics identifying individual product groups, etc. within the department. The overall store product and sign placement plan assists consumers in locating desired goods and, thereby improves the consumer's shopping experience.

Although the invention has been described with respect to particular embodiments, such embodiments are for illustrative purposes only and should not be considered to limit the invention. Various alternatives and changes will be apparent to those of ordinary skill in the art. As another example, the various attributes of sign assembly 10, sign assembly 100, sign assembly 200, and sign assembly 300 can be readily interchanged. For example, an outrigger may be formed similar to outrigger 18 but including an attachment end 210 as described with respect to sign assembly 200. In addition, sign assemblies described attaching to support wall 14 can be modified to attach to shelf 16 by interchanging the mounting bracket used and orientation of the support end of the corresponding outrigger and vice versa. Additional modifications and changes will be apparent to those of ordinary skill in the art.

What is claimed is:

1. A combination including:

a sign including a first panel and a second panel opposite the first panel; and an outrigger comprising:

a support end, an attachment end configured to be selectively coupled with the sign between the first panel and the second panel, which shield the attachment end from view, an intermediate portion extending between the support end and the attachment end, wherein the support end, the attachment end, and the intermediate portion are integrally formed of a substantially rigid material, and a mounting device configured to selectively couple with a display system, the mounting device being coupled with the support end;

wherein at least a portion of the attachment end of the outrigger extends non-linearly from the intermediate portion, wherein the attachment end and at least a portion of the intermediate portion are positioned between the first panel and the second panel of the sign, and wherein the sign further includes a spacer positioned between the first panel and the second panel and coupled with at least one of the first panel and the second panel, the intermediate portion of the outrigger extending along and interfacing with a lowermost edge of the spacer to at least partially support the sign using gravity.

2. The combination of claim 1, wherein the first panel and the second panel are substantially similar in size and shape.

3. The combination of claim 1, wherein the spacer at least partially defines a receptacle for receiving the attachment end of the outrigger.

4. The combination of claim 1, wherein the attachment end defines a spacer receptacle configured to selectively receive the spacer.

5. The combination of claim 4, wherein the spacer is generally shaped as a polygon and the spacer receptacle is generally shaped as a polygon similar to the polygon of the spacer.

6. The combination of claim 5, wherein the polygon of the spacer is generally in the shape of a trapezoid.

7. The combination of claim 1, wherein the sign further includes:

a third panel extending between the first and second panels.

8. The combination of claim 7, wherein the spacer and the third panel collectively define a reception cavity for receiving the attachment end of the outrigger.

9. The combination of claim 1, wherein the intermediate portion of the outrigger extends at least partially between the first and second panels to generally prevent rotation of the sign about the attachment end.

10. The combination of claim 1, wherein the first panel and the second panel are each substantially planar and are spaced from and extend substantially parallel to each other.

11. The combination of claim 1, wherein the outrigger is configured to be readily coupled and uncoupled with the sign.

12. The combination of claim 1, wherein the attachment end of the outrigger extends substantially perpendicularly from the intermediate portion.

13. The combination of claim 1, wherein the first panel is shaped similar to the second panel, and the spacer is shaped differently than the first panel and the second panel.

14. The combination of claim 1, wherein the attachment end and the intermediate portion each interface with the spacer to couple the outrigger to the sign via gravitational forces.

15. The combination of claim 1, wherein the sign includes a third panel, which extends between and is positioned adjacent to each of the first panel and the second panel on a side of each of the first panel and the second panel positioned opposite the display system, and the spacer is spaced from the third panel such that the attachment end of the outrigger is received between and interacts with each of the spacer and the third panel.

16. The combination of claim 1, wherein the spacer defines a receptacle extending upwardly from the lowermost edge, and the attachment end is received within the spacer.

17. The combination of claim 16, wherein the intermediate end is fully positioned outside the receptacle.

18. The combination of claim 1, wherein the outrigger substantially non-deformable.

19. The combination of claim 1, in combination with the display system, the display system including a vertical support wall and a shelf extending away from the vertical support wall with a substantially horizontal orientation, the shelf including the plurality of apertures extending parallel with and along a front edge of the shelf, wherein the front edge of the shelf is positioned opposite the vertical support wall.

20. The combination of claim 1, wherein the intermediate portion entirely extends in a plane parallel to the first panel and the second panel.

21. The combination of claim 20, wherein the attachment end extends in a plane parallel to the first panel and the second panel.

22. A combination including:

a dual-panel sign including a first panel and a second panel opposite the first panel; and an outrigger comprising:

a support end, an attachment end configured to be selectively coupled with the dual-panel sign between the first panel and the second panel, which shield the attachment end from view, an intermediate portion extending between the support end and the attachment end, wherein the support end, the attachment end, and the intermediate portion are integrally formed of a substantially rigid and non-deformable material, and a mounting device formed separately from and being configured to be selectively coupled to a display system and being coupled with the support end, the mounting device including two or more hooks each configured to interface with one of a plurality of apertures defined by the display system, wherein during use, when the mounting device is coupled with the display system, the attachment end extends upwardly from an adjacent end of the intermediate portion and is positioned above the support end to decrease interference with products supported by the display system and placed near the outrigger;

wherein at least a portion of the attachment end of the outrigger extends non-linearly from the intermediate portion, wherein the attachment end and at least a portion of the intermediate portion are positioned between the first panel and the second panel of the dual-panel sign, and wherein the dual-panel sign further includes a spacer positioned between the first panel and the second panel and coupled with at least one of the first panel and the second panel, the intermediate portion of the outrigger extending along and interfacing with a lowermost edge of the spacer to at least partially support the dual-panel sign using gravity.

* * * * *